US006638120B2

(12) United States Patent
Costa

(10) Patent No.: US 6,638,120 B2
(45) Date of Patent: Oct. 28, 2003

(54) SNAP ELECTRICAL TERMINAL

(76) Inventor: Larry J. Costa, 55613 Currant Rd., Mishawaka, IN (US) 46545

( * ) Notice: Subject to any disclaimer, the term of this patent is extended or adjusted under 35 U.S.C. 154(b) by 0 days.

(21) Appl. No.: 10/098,973

(22) Filed: Mar. 14, 2002

(65) Prior Publication Data

US 2002/0102886 A1 Aug. 1, 2002

Related U.S. Application Data

(63) Continuation-in-part of application No. 09/510,965, filed on Feb. 21, 2000, now Pat. No. 6,428,367.

(51) Int. Cl.[7] ..... H01R 4/02
(52) U.S. Cl. ..... 439/876; 439/83; 439/859
(58) Field of Search ..... 439/859, 83, 876, 439/875, 874

(56) References Cited

U.S. PATENT DOCUMENTS 4,570,338 A * 2/1986 Ignatowicz ..... 29/845
4,675,043 A * 6/1987 Conta et al. ..... 65/160
4,924,597 A * 5/1990 Tursi ..... 33/758
4,979,076 A 12/1990 DiBugnara
5,163,853 A 11/1992 Johnescu et al.
5,865,583 A * 2/1999 Krawczak et al. ..... 411/369
5,897,406 A * 4/1999 Benes et al. ..... 439/859
6,039,616 A * 3/2000 Pereira et al. ..... 439/874
6,158,726 A * 12/2000 Coleman et al. ..... 267/292

* cited by examiner

*Primary Examiner*—P. Austin Bradley
*Assistant Examiner*—Truc Nguyen
(74) *Attorney, Agent, or Firm*—Thomte, Mazour & Niebergall; Shane M. Niebergall

(57) ABSTRACT

The snap electrical terminal of the present invention includes a base having a top wall, a vertical wall, and an annular flange. The annual flange has an underside on which is disposed a ring of solder. In use, the snap electrical terminal provides a ring-shaped electrical and/or mechanical connection with the component to which it is connected. Alternate embodiments of the terminal permit the attachment of male or female threaded components thereto depending on the desired application.

7 Claims, 2 Drawing Sheets

SNAP ELECTRICAL TERMINAL

CROSS-REFERENCE TO RELATED APPLICATION

This is a continuation-in-part application of Petitioner's earlier application Ser. No. 09/510,965 filed Feb. 21, 2000, now U.S. Pat. No. 6,428,637, entitled SNAP ELECTRICAL TERMINAL.

BACKGROUND OF THE INVENTION

The present invention relates to a snap terminal which provides a ring-shaped electrical and mechanical connection with the component to which it is connected.

DESCRIPTION OF THE PRIOR ART

Electrical terminals must be connected to certain articles of manufacture to allow for the flow of electricity from one medium to a different medium. This is particularly true in instances where the conductive elements are embedded in a non-conductive material, such as glass or dielectric substrate. In, for instance, automotive glass panels having electrical wiring embedded therein for the purpose of defogging the window, electrical terminals must be attached to the glass panels to provide a point of connection for electrical current input and output.

Snap terminals are sometimes employed in this fashion. Snap terminals are generally two-piece terminals which are arranged in a mating configuration. Each of the terminals is electrically and mechanically connected to a component and the snap terminal components are then mated to form a releasable electrical and mechanical connection between the components. Snap terminals are commonly provided on 9-volt batteries.

Many snap terminals are formed with solder to be soldered onto a specific component. Such male snap terminals are generally formed in one of two ways: "staking" or "crimping." A snap terminal formed by "staking" joins two pieces. The first piece is a hat-shaped base. The hat-shaped base features a sunken top wall having a hole in its center. The side wall of the base extends upwardly from the periphery of the top wall, then downwardly to a lower end thereof. An outwardly extending annular flange extends from the lower end of the side wall. The second piece which is used in producing "stake" snap terminals is formed of solder. It consists of a circular disc of solder having a diameter that is similar to that of the annular flange. The solder disc has a perpendicular stake which extends from the center of the disc through the hole in the top wall of the base. The two pieces are pressed together so that when heat is applied the solder melts and adheres to the component.

The second type of snap terminal is formed by "crimping." A snap terminal formed by the "crimping" method also joins two pieces: a hat-shaped base and a circular solder disc. Like the base used in the "staking" method, the base used in the "crimping" method has a circular top wall, a vertical wall extending downwardly therefrom, and an annular flange. The solder disc which is joined to the base has, however, a diameter that is larger than that of the annular flange. The solder disc is placed substantially concentric to the annular flange, and the solder at the periphery of the disc is wrapped around the annular flange and crimped into place. The "crimped" snap terminal is connected to the component in the same manner as the "staked" terminal.

A newer style of male snap terminal is described in U.S. Pat. No. 5,897,406 to Benes et al. ("Benes"). The male snap electrical terminal described therein does not have a solder disc base, but has solder on the interior side wall and interior top wall of the terminal. Although the terminal described in Benes does not have a disc base, in use, the heating of the terminal to melt the solder and join the terminal to the subject component causes the solder on the interior side wall and top wall of the terminal to melt and pool at the bottom of the terminal, resulting in a disc-shaped connection between the terminal and the component.

Each style of existing snap terminal provides a solid circular connection between the terminal and the component. This configuration can be troublesome when the terminal is connected to a component having dissimilar properties such as heat expansion coefficients. If, for instance, a terminal is mounted on glass, a change in temperature will cause the expansion or contraction of the terminal, but have essentially no impact on the expansion or contraction of the glass. The solid circular connection prevents the deformation of the base and puts strain on both the connection and the glass.

SUMMARY OF THE INVENTION

A male snap terminal is described which includes a base having a top wall, a vertical wall, and an annular flange, and which has a ring of solder on the annular flange, which provides a ring-shaped electrical and mechanical connection with the component to which it is connected. The ring-shaped electrical and mechanical connection allows the terminal to flex when stressed, such as by thermal expansion. Furthermore, the snap electrical terminal of this invention may be manufactured in one of two ways, either of which includes only two mechanical steps.

The snap terminal of the present invention is provided with alternate embodiments that enable the snap terminal to receive both male and female components. These alternate embodiments provide for hardware attachment points without first drilling holes into the substrate to which the terminal is to be attached.

It is therefore a principal object of the invention to provide a snap terminal that provides a ring-shaped electrical and/or mechanical connection with the component to which it is connected.

Yet another object of the invention is to provide a snap terminal requiring only two mechanical steps for its manufacture.

Still another object of the present invention is to provide a snap terminal capable of receiving threaded connectors.

These and other objects will be apparent to those skilled in the art.

DESCRIPTION OF THE PREFERRED EMBODIMENT

Figure 1:
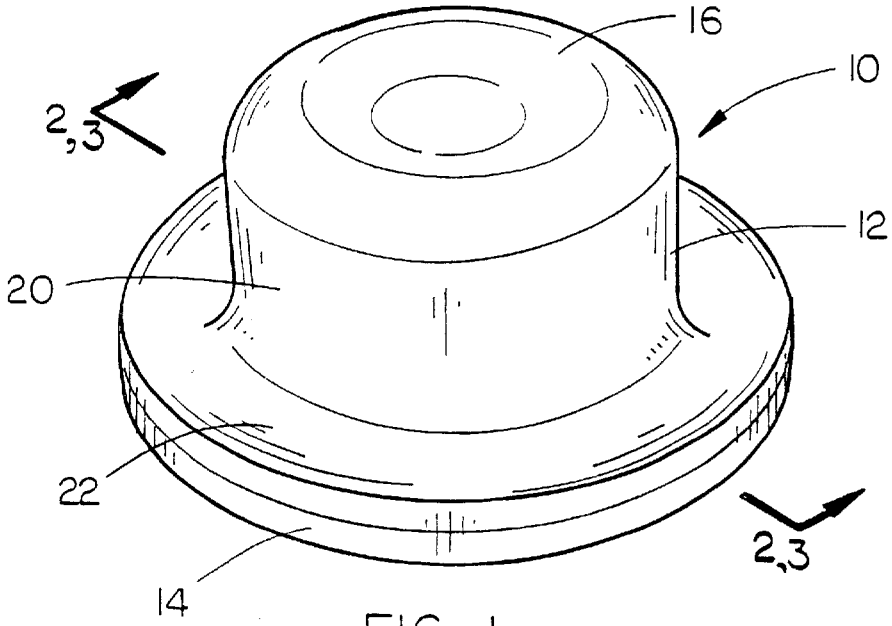
FIG. 1 is a perspective view of the snap terminal of the present invention.
Figure 2:
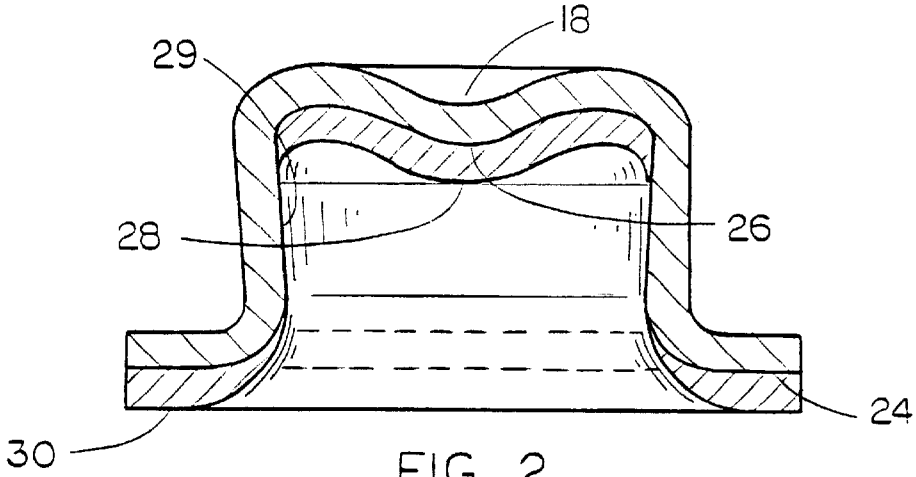
FIG. 2 is a cross-sectional view of a snap terminal formed by the "pre-clad" method.
Figure 3:
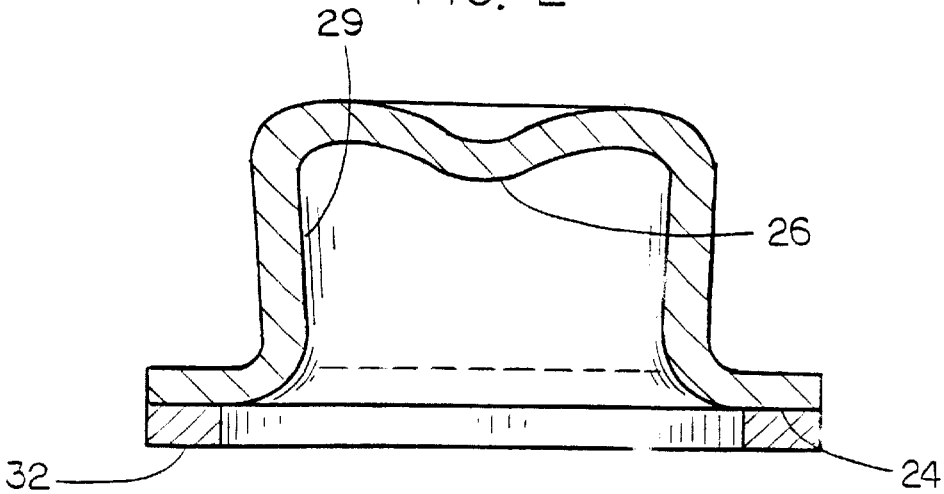
FIG. 3 is a cross-sectional view of a snap terminal formed by the "reflow" method.

The numeral 10 refers generally to the snap electrical terminal of this invention. Terminal 10 includes a base 12 and a ring of solder 14. The base 12 is generally hat-shaped and has a circular, generally horizontal top wall 16. Preferably, top wall 16 includes a concave indentation 18. An annular, generally vertical wall 20 is connected to the periphery of the top wall 16 and extends downwardly therefrom to a lower end of the vertical wall 20. Preferably, the vertical wall 20 tapers slightly inwardly. The lower end of the vertical wall 20 has extending outwardly therefrom an annular, generally horizontal flange 22.

The annular flange 22 of the terminal 10 has an underside 24. The underside 24 is the contact point between the terminal 10 and the component (not shown) to which the terminal 10 is to be connected. Such a connection may be made by conductive adhesive, but is usually achieved by soldering. Toward this end, the present structure includes solder on the underside 24 of the terminal 10. The terminal 10 may be manufactured to include solder on the underside 24 of the annular flange 22 by either a "preform" method or a "reflow" method. It is also contemplated that a non-conductive adhesive material, of which many are known in the art, to create a mechanical connection between the terminal 10 and the component when an electrical connection is not necessary.

In the preform method, the terminal 10 is stamped out of a flat strip of solder-clad material. The solder cladding is positioned on the side of the strip that becomes the underside 24 of the annular flange 22. In the stamping process, excess solder clad material 28 is positioned on the underside 26 of the top wall 16. No solder remains on the interior 29 of the vertical wall 20. When carefully attached, only the solder cladding 30 on the underside 24 of the annular flange 22 will come in contact with the component to which the terminal 10 is to be connected. Once soldered into place, the terminal 10 will have a ring-shaped electrical and mechanical connection to the component.

In the reflow method, the preferred method of manufacture, the base 12 is stamped out of metal that does not have solder cladding. A layer of molten solder 32 is applied to the underside 24 of the flange 22. The resulting terminal 10 has solder 32 on the underside 24 of the annular flange 22 but does not have solder on the underside 26 of the top wall 16 or the interior 29 of the vertical wall 20. Like the terminal 10 formed by the preform method, the terminal 10 formed by the reflow method provides a ring-shaped electrical and mechanical connection with the component to which it is connected. Additionally, no solder exists on the underside 26 of the top wall 16 that can melt and form a disc-shaped connection.

The ring-shaped mechanical and electrical connection formed between the terminal 10 and the component provides several benefits. Unlike the solid circular connections created by prior art snap terminals, the ring-shaped connection allows for the thermal expansion of the snap terminal 10 regardless of the difference in the coefficient of thermal expansion between the terminal 10 and the component. Since the terminal is allowed to expand and contract more freely, less stress is placed on the connection and the component. This is especially true in instances where the terminal 10 is to be connected to a component made of glass. The stress between prior art snap terminals and glass components has occasionally resulted in the fracturing of the glass due to the differing rates of expansion and contraction of the prior art terminals and the glass. The terminal 10 of the instant invention is less likely to cause this problem.

The terminal 10 requires only two steps to be manufactured. In the preform method, the terminal 10 is made by first laminating a metal strip with solder, then by stamping the terminal 10 from the strip. In the reflow method, the first step in the manufacture of the terminal 10 is the stamping of the base 12 and the second step is reflowing molten solder onto the underside 24 of the annular flange 22. Many prior art pre-soldered snap terminals require a minimum of three steps of manufacture. Accordingly, the terminal 10 of this invention will be more efficiently and less expensively manufactured than prior art terminals.

The ring-shaped electrical connection between the terminal and the component is as electrically efficient as the prior art circular electrical connection. Assuming that the diameter of the ring-shaped connection is equal to the diameter of the circular connection, each connection is capable of carrying the same current. Electricity flows on the outer surface of conductive materials. The outer surface of the ring-shaped connection would be equal to the outer surface of the circular connection and would, therefore, carry an equal amount of current. No electrical efficiency need be sacrificed to achieve the benefits of the terminal 10.

When a particular application calls for the terminal 10 to receive either a male or female-threaded component, the structural configuration of terminal 10 is easily modified. For example, after the terminal 10 is stamped, an opening 34 can be formed in the indentation 18 of top wall 16 using a conventional press. Then, using either a tap or thread former, a series of threads 36 are formed in the vertical wall 38 of opening 34. An example of such a threaded snap terminal is shown in FIG. 4.

Figure 4:
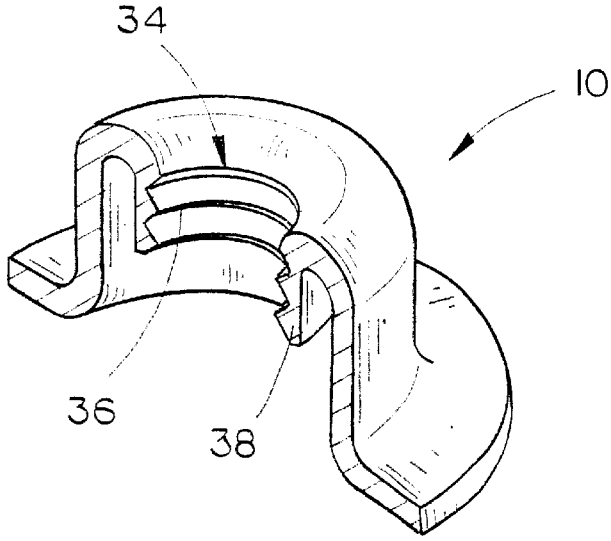
FIG. 4 is a cross-sectional view of the snap terminal of FIG. 1 formed with a threaded opening therein.
Figure 5:
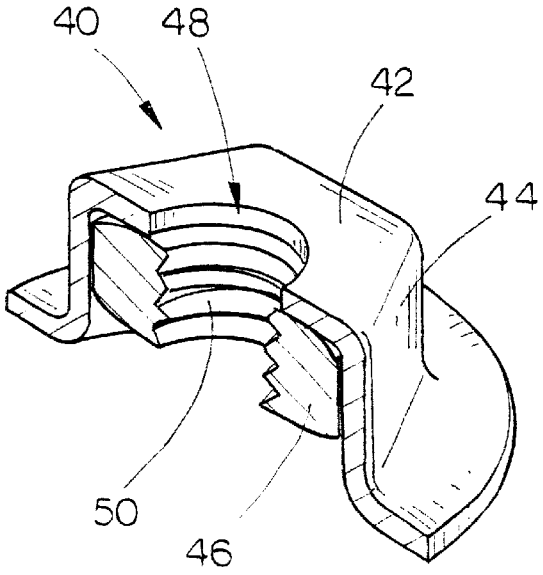
FIG. 5 is a cross-sectional view of an alternate embodiment of the threaded snap terminal of FIG. 4.

An alternate embodiment of the female-threaded snap terminal of FIG. 4 is depicted as terminal 40 in FIG. 5. The female-threaded terminal 40 is formed in nearly the same manner as terminal 10 except that the terminal is punched from the base material in a generally hexagonal shape. The top wall 42 and side wall 44 are formed to have a shape and size to accommodate a hex-nut 46, which is press-fit within terminal 40. An opening 48 is formed in top wall 42 to align with the threaded center hole 50 of hex-nut 46. It is contemplated that the terminal 40 and hex-nut 46 could have one of any number of shapes, depending on the desired application, and should not be restricted to hexagonal alone.

Figure 6:
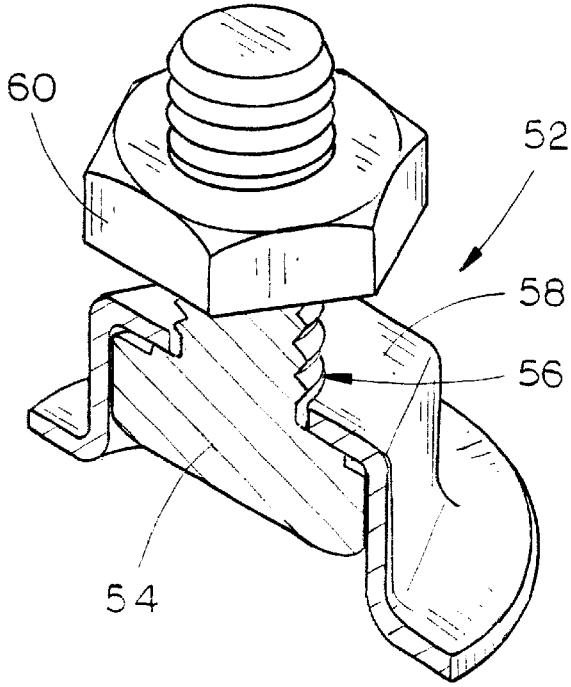
FIG. 6 is an alternate embodiment of the snap terminal of FIG. 1 formed with a threaded bolt extending outwardly therefrom.

FIG. 6 depicts another alternate embodiment of the present invention, which can be used when the given application requires a male-threaded terminal for receiving threaded components. Terminal 52 is formed in much the same manner as terminal 40 except that a threaded bolt 54 is press-fit within the terminal after it is punched from the base material so that the threaded end of the bolt 54 extends outwardly from opening 56 and top wall 58. In this position, a desired component can be received by bolt 54 and secured against top wall 58 with nut 60 or other similar structure.

Terminals 40 and 52 can, much like terminal 10, be used in conjunction with either the preform or reflow methods.

In the drawings and in the specification, there have been set forth preferred embodiments of the invention; and although specific items are employed, these are used in a generic and descriptive sense only and not for purposes of limitation. Changes in the form and proportion of parts, as well as substitute of equivalents, are contemplated as circumstances may suggest or render expedient without departing from the spirit or scope of the invention as further defined in the following claims.

Thus it can be seen that the invention accomplishes at least all of its stated objectives.

I claim:

1. A terminal for connection to a component, comprising:

a generally hat-shaped base having a generally horizontal top wall having an opening formed therethrough and a periphery, a generally vertical wall connected to said periphery and extending downwardly therefrom to a lower end thereof, and a generally horizontal annular flange connected to said lower end of said vertical wall and extending outwardly therefrom;

means for receiving threaded components operatively coupled to the opening; and a generally ring-shared layer of conductive adhesive material;

wherein said ring-shaped layer of conductive adhesive material being operatively connected to said horizontal annular flange to provide a ring-shaped electrical and mechanical connection between the horizontal annular flange and the component.

2. The terminal of claim 1 wherein said ring-shaped layer of conductive adhesive material is comprised of solder.

3. The terminal of claim 2 wherein said solder is applied to said terminal.

4. The terminal of claim 3 wherein said vertical wall is free of solder.

5. The terminal of claim 4 wherein said terminal is formed from a solder clad strip of conductive material.

6. The terminal of claim 4 wherein said horizontal top wall is free of solder.

7. The terminal of claim 6 wherein said terminal is formed from a strip of conductive material and molten solder is reflowed onto said horizontal annular flange.

* * * * *